US008350638B2

(12) United States Patent
White et al.

(10) Patent No.: US 8,350,638 B2
(45) Date of Patent: Jan. 8, 2013

(54) CONNECTOR ASSEMBLY FOR PROVIDING CAPACITIVE COUPLING BETWEEN A BODY AND A COPLANAR WAVEGUIDE AND METHOD OF ASSEMBLING

(75) Inventors: Carson R. White, Calabasas, CA (US); Hyok Jae Song, Camarillo, CA (US); Hui Pin Hsu, Northridge, CA (US); Eray Yasan, Canton, MI (US)

(73) Assignee: General Motors LLC, Detroit, MI (US)

( * ) Notice: Subject to any disclaimer, the term of this patent is extended or adjusted under 35 U.S.C. 154(b) by 314 days.

(21) Appl. No.: 12/622,683

(22) Filed: Nov. 20, 2009

(65) Prior Publication Data

US 2011/0121924 A1 May 26, 2011

(51) Int. Cl.
*H01P 5/02* (2006.01)

(52) U.S. Cl. ..... 333/24 C; 333/33; 333/260

(58) Field of Classification Search ..... 333/24 C, 333/33, 260, 246, 247
See application file for complete search history.

(56) References Cited

U.S. PATENT DOCUMENTS

| | | | | |
|---|---|---|---|---|
| 5,543,386 | A * | 8/1996 | Findikoglu et al. | 505/210 |
| 5,631,446 | A * | 5/1997 | Quan | 174/254 |
| 5,973,648 | A | 10/1999 | Lindenmeier et al. | |
| 6,032,054 | A | 2/2000 | Schwinke | |
| 6,211,831 | B1 | 4/2001 | Nagy et al. | |
| 6,366,249 | B1 | 4/2002 | Jones et al. | |
| 6,417,747 | B1 * | 7/2002 | Dearden et al. | 333/247 |
| 6,617,943 | B1 * | 9/2003 | Fazelpour | 333/204 |
| 6,728,113 | B1 * | 4/2004 | Knight et al. | 361/760 |
| 6,795,741 | B2 | 9/2004 | Simon | |
| 6,847,276 | B2 * | 1/2005 | Tamaki et al. | 333/260 |
| 6,853,337 | B2 * | 2/2005 | Barabash | 343/702 |
| 6,861,991 | B2 | 3/2005 | Mueller et al. | |
| 7,015,860 | B2 | 3/2006 | Alsliety | |
| 7,053,845 | B1 | 5/2006 | Holloway et al. | |
| 7,233,296 | B2 | 6/2007 | Song et al. | |
| 7,342,547 | B2 | 3/2008 | Maniwa et al. | |
| 7,427,961 | B2 | 9/2008 | Song et al. | |
| 2003/0103010 | A1 | 6/2003 | Boyle | |
| 2010/0164790 | A1 | 7/2010 | Wisnewski et al. | |

OTHER PUBLICATIONS

Ellis, T.J., et al. "A wideband CPW-to-microstrip transition for millimeter-wave packaging," IEEE MTT-S International Microwave Symposium Digest, 1999, pp. 629-632, vol. 2.

(Continued)

*Primary Examiner* — Benny Lee
(74) *Attorney, Agent, or Firm* — Ingrassia Fisher & Lorenz, P.C.

(57) ABSTRACT

A connector assembly includes, but is not limited to, a body having a top side and a bottom side. A bottom signal plate is connected to the bottom side and is configured for capacitive coupling to a conductor of a coplanar waveguide. A bottom grounding plate is connected to the bottom side and is spaced apart from the bottom signal plate. The bottom grounding plate is configured for capacitive coupling to a grounding plane of the coplanar waveguide. A first electrically conductive pathway is electrically connected to the bottom signal plate and extends to the top side. A second electrically conductive pathway is electrically connected to the bottom grounding plate and extends to the top side. A dielectric adhesive at least partially covers a bottom portion of the connector assembly.

14 Claims, 5 Drawing Sheets

OTHER PUBLICATIONS

Lin, T.-H. "Via-free broadband microstrip to CPW transition," IEEE Electronic Letters, Jul. 19, 2001, pp. 960-961, vol. 37, No. 15.

Houdart, M., et al. "Various Excitation of Coplanar Waveguide," IEEE MTT-S International Microwave Symposium Digest, Apr. 1979, pp. 116-118, vol. 79, No. 1.

Hopf, J. F. et al. "Compact Multi-antenna System for Cars with Electrically Invisible Phone Antennas for SDARS Frequencies," 2nd International ITG Conference on Antennas, Mar. 2007, pp. 171-175.

Chiu, C-Y., et al. "Reduction of Mutual Coupling Between Closely-Packed Antenna Elements," IEEE Transactions on Antennas and Propagation, Jun. 2007, pp. 1732-1738, vol. 55, No. 6.

Andersen, J., et al. "Decoupling and Descattering Networks for Antennas," IEEE Transactions on Antennas and Propagation, Nov. 1976, pp. 841-846, vol. 24, No. 6.

Bao, X., et al., "Dual-Frequency Dual-Sense Circularly-Polarized Slot Antenna Fed by Microstrip Line," IEEE Transactions on Antennas and Propagation, Mar. 2008, pp. 645-649, vol. 56, No. 3.

Sze, J.-Y., et al., "Circularly Polarized Square Slot Antenna With a Pair of Inverterd-L Grounded Strips," IEEE Antennas and Wireless Propagation Letters, 2008, pp. 149-151, vol. 7.

Jan, J.-Y., et al. "Wideband CPW-fed Slot Antenna for DCS, PCS, 3G and Bluetooth Bands," IEEE Electronics Letters, Nov. 23, 2006, pp. 1377-1378, vol. 42, No. 24.

White, C. R., et al. "Microwave Antenna Assemblies," U.S. Appl. No. 12/886,310, filed Sep. 20, 2010.

Song, H.J., et al. "Antenna System and Filter," U.S. Appl. No. 12/886,322, filed Sep. 20, 2010.

Song, H.J., et al. "Multi-Function Antenna," U.S. Appl. No. 12/952,992, filed Nov. 23, 2010.

Waterhouse, R.B., et al. "Small Folded CPW Fed Slot Antennas," IEEE Antennas and Propagation Society International Symposium, Jul. 2006, pp. 2599-2602.

Chen, C., et al., "Dual-band dual-sense circularly-polarized CPW-fed slot antenna with two spiral slots loaded," IEEE Transactions on Antennas and Propagation, Jun. 2009, pp. 1829-1833, vol. 57, No. 6.

Office Action, dated Nov. 6, 2012, for U.S. Appl. No. 12/886,322.

Office Action, dated Oct. 26, for U.S. Appl. No. 12/886,310.

Robert A. Sainati, CAD of Microstrip for Wireless Applications, ISBN 0-89006-562-4, 1996, pp. 29-30 and 92-94.

* cited by examiner

CONNECTOR ASSEMBLY FOR PROVIDING CAPACITIVE COUPLING BETWEEN A BODY AND A COPLANAR WAVEGUIDE AND METHOD OF ASSEMBLING

TECHNICAL FIELD

The technical field generally relates to connector assemblies, and more particularly relates to connector assemblies used for the transmission of electromagnetic waves.

BACKGROUND

Some antennas for transmitting and receiving electromagnetic waves are configured as thin film antennas. A thin film antenna includes a thin substrate material, (for example, plastic), which bonds with and supports a thin layer of metallization (for example, metalized copper). Thin film antennas may be attached to surfaces without significantly altering the profile of the surface. Additionally, thin film antennas may be relatively flexible and, for this reason, may be easily attached to curved or contoured surfaces in a conformal manner. Furthermore, depending on the amount of metallization, thin film antennas may also be transparent and, for this reason, may be more esthetically pleasing than traditional antennas.

Thin film antennas, such as those disclosed in U.S. Pat. No. 7,427,961, may include a coplanar waveguide to guide the electromagnetic waves to and from the thin film antenna. Coplanar waveguides typically are contiguous with the thin film antenna and are constructed of the same materials.

Currently, many applications that utilize conventional antennas also utilize waveguides, such as a coaxial cable, to transmit electromagnetic waves between the conventional antenna and a receiver. Coaxial cables are typically mechanically connected or soldered to the leads extending from a conventional antenna. Attaching a coaxial cable directly to the coplanar waveguide of a thin film antenna in this manner, however, may be impracticable. This is because the substrate of the coplanar waveguide may not be structurally robust enough to support a mechanical fastener and the application of molten solder may melt or otherwise damage the coplanar waveguide.

Accordingly, it is desirable to connect a conventional waveguide, such as a coaxial cable, to a coplanar waveguide in a manner that provides a robust attachment and that does not significantly alter the coplanar waveguide. Furthermore, it is desirable that this connection have low insertion loss over the entire bandwidth of the antenna, and that the fabrication tolerances be achievable. These and other desirable features and characteristics will become apparent from the subsequent detailed description and the appended claims, taken in conjunction with the accompanying drawings and the foregoing technical field and background.

SUMMARY

Apparatuses and methods are provided herein for connector assemblies. In a first non-limiting example, a connector assembly includes, but is not limited to a body having a top side and a bottom side. A bottom signal plate is connected to the bottom side. The bottom signal plate is configured for capacitive coupling to a conductor of a coplanar waveguide. A bottom grounding plate is connected to the bottom side and spaced apart from the bottom signal plate. The bottom grounding plate is configured for capacitive coupling to a grounding plane of the coplanar waveguide. A first electrically conductive pathway is electrically connected to the bottom signal plate and extends to the top side. A second electrically conductive pathway is electrically connected to the bottom grounding plate and extends to the top side. A dielectric adhesive at least partially covers a bottom portion of the connector assembly.

In a second non-limiting example, a connecting arrangement includes, but is not limited to a coplanar waveguide having a center conductor and a grounding plane and a connector assembly connected to the coplanar waveguide. The connector assembly includes, but is not limited to, a body having a top side and a bottom side. A bottom signal plate is connected to the bottom side. A bottom grounding plate is connected to the bottom side and is spaced apart from the bottom signal plate. A first electrically conductive pathway is electrically connected to the bottom signal plate and extends to the top side. A second electrically conductive pathway is electrically connected to the bottom grounding plate and extends to the top side. A dielectric adhesive at least partially covers a bottom portion of the connector assembly. In this second non-limiting example, the bottom conducting plate is capacitively coupled with the center conductor, the bottom grounding plate is capacitively coupled with the grounding plane, and the dielectric adhesive adheres the connector assembly to the coplanar waveguide.

In a third non-limiting example, a method of assembly that utilizes the connector assembly is provided. The method includes, but is not limited to the following steps. A coplanar waveguide is provided having a center conductor and a grounding plane. A connector assembly is also provided. The connector assembly includes, but is not limited to, a body having a top side and a bottom side, a bottom signal plate that is connected to the bottom side, a bottom grounding plate that is connected to the bottom side and spaced apart from the bottom signal plate, a first electrically conductive pathway that is electrically connected to the bottom signal plate and extends to the top side, a second electrically conductive pathway that is electrically connected to the bottom grounding plate and extends to the top side, and a dielectric adhesive that at least partially covers a bottom portion of the connector assembly. The connector assembly is aligned with the coplanar waveguide such that the bottom signal plate aligns with the center conductor and such that the bottom grounding plate aligns with the grounding plane. The connector assembly and the coplanar waveguide are pressed together such that the dielectric adhesive adheres the connector assembly to the coplanar waveguide.

BRIEF DESCRIPTION OF THE DRAWINGS

One or more embodiments will hereinafter be described in conjunction with the following drawing figures, wherein like numerals denote like elements throughout the drawing figures and may not be described in detail for all drawing figures in which they appear.

DETAILED DESCRIPTION

Figure 1:
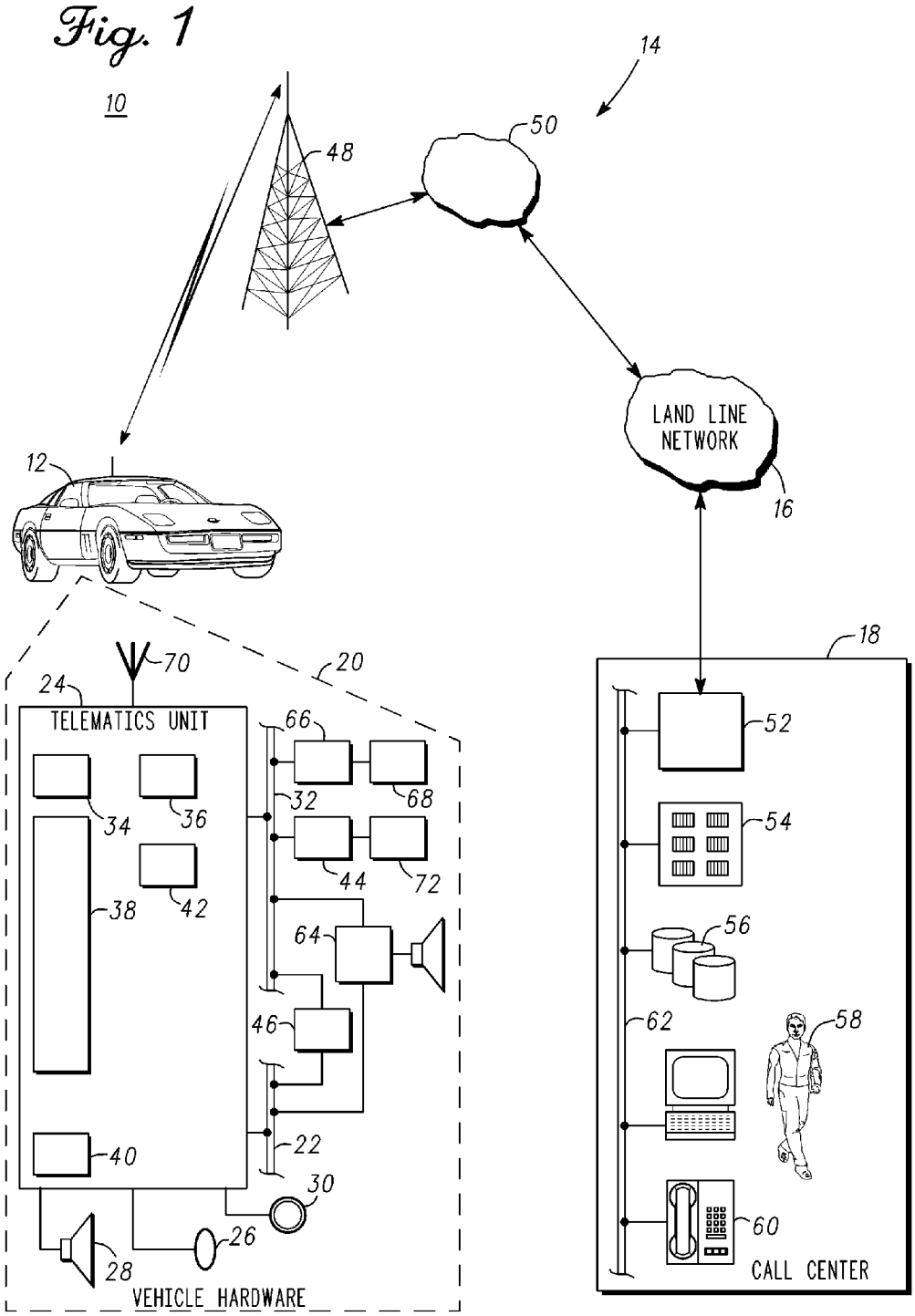
FIG. 1 is a schematic view illustrating a non-limiting example of a communication system suitable for use with connector assemblies made in accordance with the teachings disclosed herein.

The following detailed description is merely exemplary in nature and is not intended to limit application and uses. Furthermore, there is no intention to be bound by any expressed or implied theory presented in the preceding technical field, background, brief summary or the following detailed description.

Disclosed herein is a connector assembly that is attached to the coplanar waveguide by a thin layer of a dielectric adhesive. Although the dielectric adhesive will electrically insulate the coplanar waveguide from the connector assembly, when the dielectric adhesive is applied in layers that are sufficiently thin, the connector assembly can, nevertheless, receive and convey the electromagnetic wave from the coplanar waveguide through capacitive coupling between the connector assembly and the coplanar waveguide.

In a non-limiting example, the connector assembly includes a body, such as a printed circuit board, that serves as a platform for mounting additional components. Although the discussion contained herein centers around the use of a printed circuit board to serve as the body, it should be understood that any component made of a dielectric material may alternatively be employed to serve as the body. The bottom side of the body is adhered to the coplanar waveguide by the adhesive while the top side of the body may be configured to receive a conventional waveguide such as a coaxial cable.

The body includes first and second spaced apart electrically conductive pathways. The first and the second electrically conductive pathways extend from the bottom side to the top side of the body. In one non-limiting example, the first and the second electrically conductive pathways may be via holes. As used herein, the term "via hole" refers to a hole through the body having internal walls that are coated with a metal or other electrically conductive material. The holes may be drilled, bored, integrally molded or otherwise formed through the body. The walls of the holes may be coated with the electrically conductive material through a metal plating process, through a vacuum metallization process, or through any other process effective for coating the walls with an electrically conductive material. In other examples, the first and the second electrically conductive pathways may include electrical conductors that are embedded within the body, or which are otherwise disposed within holes extending from the top side to the bottom side.

The connector assembly may also include a bottom signal plate that is connected to the bottom side of the body and that is electrically connected to the first electrically conductive pathway. The bottom conductor may be configured and dimensioned so as to facilitate capacitive coupling with the coplanar waveguide. For example, the bottom signal plate may have a periphery that has a smaller footprint than a center conductor of the coplanar waveguide. Additionally, the bottom signal plate may have a very thin profile. In some examples, the thickness of the bottom signal plate may be between 0.001 and 0.5 mm. In other examples, the thickness of the bottom signal plate may be between 0.005 and 0.1 mm. In still other examples, the thickness of the bottom signal plate may be between 0.01 to 0.05 mm. In still other examples, the bottom signal plate may have any other desirable or suitable thickness.

In some examples, a microstrip may be attached to the top side of the body. As used herein, the term "microstrip" refers to a type of transmission line which can be fabricated using printed circuit board technology and which is used as a waveguide to convey signals. Microstrips are commonly used on printed circuit boards for conveying digital signals, as well as analog signals from 0 Hz to more than 50 GHz. The microstrip is electrically connected to the first electrically conductive pathway and is therefore electrically connected to the bottom signal plate.

A bottom grounding plate may be connected to the bottom side of the body and positioned in a spaced apart relationship with the bottom signal plate. The bottom grounding plate may be configured to facilitate capacitive coupling with a grounding plane of the coplanar waveguide. For example, the bottom grounding plate may have a footprint that permits alignment with the grounding plane of the coplanar waveguide without crossing over a gap that separates the grounding plane from the center conductor of the coplanar waveguide. Further, the bottom grounding plate may have a relatively thin profile. In some examples, the thickness of the bottom grounding plate may be between 0.001 and 0.5 mm. In other examples, the thickness of the bottom grounding plate may be between 0.005 and 0.1 mm. In still other examples, the thickness of the bottom grounding plate may be between 0.01 to 0.05 mm. In still other examples, the bottom grounding plate may have any other desirable or suitable thickness. Additionally, the bottom grounding plate is positioned on the bottom side of the body to electrically connect with the second electrically conductive pathway.

A top grounding plate may be positioned on the top side of the body in a spaced apart relationship with the microstrip. The top grounding plate is electrically connected to the second electrically conductive pathway and therefore is electrically connected to the bottom grounding plate.

The top and bottom grounding plates, the microstrip, and the bottom signal plate may be made of any suitable electrically conductive material. In some examples, these components may be made of copper. In other examples, these components may be made of copper having a surface finish such as Electroless Nickel, Immersion Gold, or solder finish to ease the soldering process. In other examples, gold and brass may be utilized. In still other examples, any conducting material to which a coaxial cable can be both electrically connected and mechanically connected may be utilized.

The dielectric adhesive at least partially covers a bottom portion of the connector assembly. In some examples, the dielectric adhesive may either cover or at least partially cover a bottom portion of the bottom signal plate. In other examples, the dielectric adhesive may cover or at least partially cover a bottom portion of the bottom grounding plate. In still other examples, the dielectric adhesive may at least partially cover bottom or may entirely cover bottom portions of both the bottom signal plate and the bottom grounding plate. The dielectric adhesive may be applied using a transfer tape that has a removable backing which is removed at the time that the connector assembly is assembled to the coplanar waveguide. The dielectric adhesive may be relatively thin which may facilitate capacitive coupling between the connector assembly and the coplanar waveguide. In some examples, the layer of dielectric adhesive may have a thickness of 0.002 inches. While a suitable thickness of the dielectric adhesive will vary with the frequency of operation of the connector assembly, the size of the plates and the dielectric constant of the adhesive, the dielectric layer is preferably thick enough to provide a secure mechanical bond and thin enough to enable capacitive coupling.

A connecting arrangement may be formed between the connector assembly and the coplanar waveguide using the dielectric adhesive. The connector assembly may be positioned adjacent the coplanar waveguide such that the bottom signal plate aligns with the center conductor of the coplanar waveguide and such that the grounding plane of the connector assembly aligns with the grounding plane of the coplanar waveguide. With the connector assembly and the coplanar waveguide arranged in this manner, the connector assembly may be pressed onto the coplanar waveguide and will thereafter be held in position with respect to the coplanar waveguide by the dielectric adhesive which may provide a relatively robust connection.

A waveguide or transmission line may also be attached to the connector assembly. In one non-limiting example, a coaxial cable having an outer grounding shield (hereinafter "grounding shield") and an internal central conductor (hereinafter "central conductor") may be connected to the top side of the body. The coaxial cable may be positioned on the connector assembly such that the grounding shield is electrically connected to the top grounding plate and such that the central conductor is electrically connected to the microstrip. The coaxial cable may then be attached to the connector assembly through the use of solder, conductive epoxy, a mechanical fastener or in any other way effective to maintain the electrical connection between the respective grounding portions and the respective signal portions of the coaxial cable and the connector assembly.

In the arrangement described above, the bottom signal plate serves to capacitively couple the center conductor of the coplanar waveguide with the microstrip. By virtue of the capacitive coupling, the microstrip can receive the transmission of an electromagnetic signal from the coplanar waveguide. The microstrip, in turn, conveys the signal to the central conductor of the coaxial cable. Those skilled in the art recognize that loss of signal strength is minimized when the length and characteristic impedance of the microstrip is chosen appropriately in order to impedance match the coplanar waveguide to the coaxial cable. In some examples, it may be desirable to ensure that the transitions between all of the different types of transmission lines (e.g., coplanar waveguide to microstrip; microstrip to coaxial cable, etc. . . . ) are small by comparison with the wavelength of the signal that the transmission line conveys. This may help to prevent parasitic impedances which can cause reflections and/or radiation loss which, in turn, may cause loss of signal strength or decrease in bandwidth. In some examples, wideband low-loss performance is achieved by designing the characteristic impedances of the microstrip and CPW to be substantially the same as that of the coax. In one example in particular, an insertion loss of less than 0.5 dB is achieved over the entire frequency range of 0.9 GHz to 2.4 GHz with a tolerance for alignment errors of a least ±0.08 inches in any direction.

A greater understanding of the examples of the apparatus disclosed herein may be obtained through a review of the illustrations accompanying this application together with a review of the detailed description that follows.

With reference to FIG. 1, there is shown a non-limiting example of a communication system 10 that may be used in conjunction with examples of the apparatus disclosed herein. The communication system generally includes a vehicle 12, a wireless carrier system 14, a land line network 16 and a call center 18. It should be appreciated that the overall architecture, setup and operation, as well as the individual components of the illustrated system are merely exemplary and that differently configured communication systems may also be utilized in conjunction with the examples of the apparatus disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, etc., and is equipped with suitable hardware and software that enables it to communicate over communication system 10. Some of the vehicle hardware 20 is shown generally in FIG. 1, including a telematics unit 24, a microphone 26, a speaker 28, and buttons and/or controls 30 connected to the telematics unit 24. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard device that provides a variety of services through its communication with the call center 18, and generally includes an electronic processing device 38, one or more types of electronic memory 40, a cellular chipset/component 34, a wireless modem 36, a dual mode antenna 70, and a navigation unit containing a GPS chipset/component 42. In one example, the wireless modem 36 includes a computer program and/or set of software routines adapted to be executed within electronic processing device 38.

The telematics unit 24 may provide various services including: turn-by-turn directions and other navigation-related services provided in conjunction with the GPS based chipset/component 42; airbag deployment notification and other emergency or roadside assistance-related services provided in connection with various crash and/or collision detection sensor interface modules 66 and collision sensors 68 located throughout the vehicle; and/or infotainment-related services where music, Internet web pages, movies, television programs, videogames, and/or other content are downloaded by an infotainment center 46 operatively connected to the telematics unit 24 via vehicle bus 32 and audio bus 22. In one example, downloaded content is stored for current or later playback. The above-listed services are by no means an exhaustive list of all the capabilities of telematics unit 24, but are simply an illustration of some of the services that the telematics unit may be capable of offering. It is anticipated that telematics unit 24 may include a number of additional components in addition to and/or different components from those listed above.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. In order to enable successful data transmission over the voice channel, wireless modem 36 applies some type of encoding or modulation to convert the digital data so that it can be communicated through a vocoder or speech codec incorporated in the cellular chipset/component 34. Any suitable encoding or modulation technique that provides an acceptable data rate and bit error can be used with the present examples. Dual mode antenna 70 services the GPS based chipset/component 42 and the cellular chipset/component 34.

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with the telematics unit 24 or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more components of the vehicle hardware 20. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The vehicle audio component 64 is operatively connected to the vehicle bus 32 and the audio bus 22. The vehicle audio component 64 receives analog information, rendering it as sound, via the audio bus 22. Digital information is received via the vehicle bus 32. The vehicle audio component 64 provides amplitude modulated (AM) and frequency modulated (FM) radio, compact disc (CD), digital video disc (DVD), and multimedia functionality independent of the infotainment center 46. Vehicle audio component 64 may contain a speaker system, or may utilize speaker 28 via arbitration on vehicle bus 32 and/or audio bus 22.

The vehicle crash and/or collision detection sensor interface modules 66 is operatively connected to the vehicle bus 32. The collision sensors 68 provide information to the telematics unit via the crash and/or collision detection sensor interface modules 66 regarding the severity of a vehicle collision, such as the angle of impact and the amount of force sustained.

Vehicle sensors 72, connected to various sensor interface modules 44 are operatively connected to the vehicle bus 32. Example vehicle sensors include but are not limited to gyroscopes, accelerometers, magnetometers, emission detection, and/or control sensors, and the like. Example sensor interface modules 44 include powertrain control, climate control, and body control, to name but a few.

Wireless carrier system 14 may be a cellular telephone system or any other suitable wireless system that transmits signals between the vehicle hardware 20 and land line network 16. According to an example, wireless carrier system 14 includes one or more cell towers 48, base stations and/or mobile switching centers (MSCs) 50, as well as any other networking components required to connect the wireless carrier system 14 with land network 16. As appreciated by those skilled in the art, various cell tower/base station/MSC arrangements are possible and could be used with wireless carrier system 14. For example, a base station and a cell tower could be co-located at the same site or they could be remotely located, and a single base station could be coupled to various cell towers or various base stations could be coupled with a single MSC, to list but a few of the possible arrangements. A speech codec or vocoder may be incorporated in one or more of the base stations, but depending on the particular architecture of the wireless network, it could be incorporated within a Mobile Switching Center or some other network components as well.

Land line network 16 can be a conventional land-based telecommunications network that is connected to one or more landline telephones, and that connects wireless carrier system 14 to call center 18. For example, land line network 16 can include a public switched telephone network (PSTN) and/or an Internet protocol (IP) network, as is appreciated by those skilled in the art. Of course, one or more segments of the land line network 16 can be implemented in the form of a standard wired network, a fiber or other optical network, a cable network, other wireless networks such as wireless local networks (WLANs) or networks providing broadband wireless access (BWA), or any combination thereof.

Call center 18 is designed to provide the vehicle hardware 20 with a number of different system back-end functions and, according to the example shown here, generally includes one or more switches 52, servers 54, databases 56, advisors 58, as well as a variety of other telecommunication/computer equipment 60. These various call center components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either the live advisor 58 or an automated response system, and data transmissions are passed on to a modem or other piece of telecommunication/computer equipment 60 for demodulation and further signal processing. The telecommunication/computer equipment 60 may include an encoder, as previously explained, and can be connected to various devices such as a server 54 and database 56. For example, database 56 could be designed to store subscriber profile records, subscriber behavioral patterns, or any other pertinent subscriber information. Although the illustrated example has been described as it would be used in conjunction with a manned call center 18, it will be appreciated that the call center 18 can be any central or remote facility, manned or unmanned, mobile or fixed, to or from which it is desirable to exchange voice and data.

Figure 2:
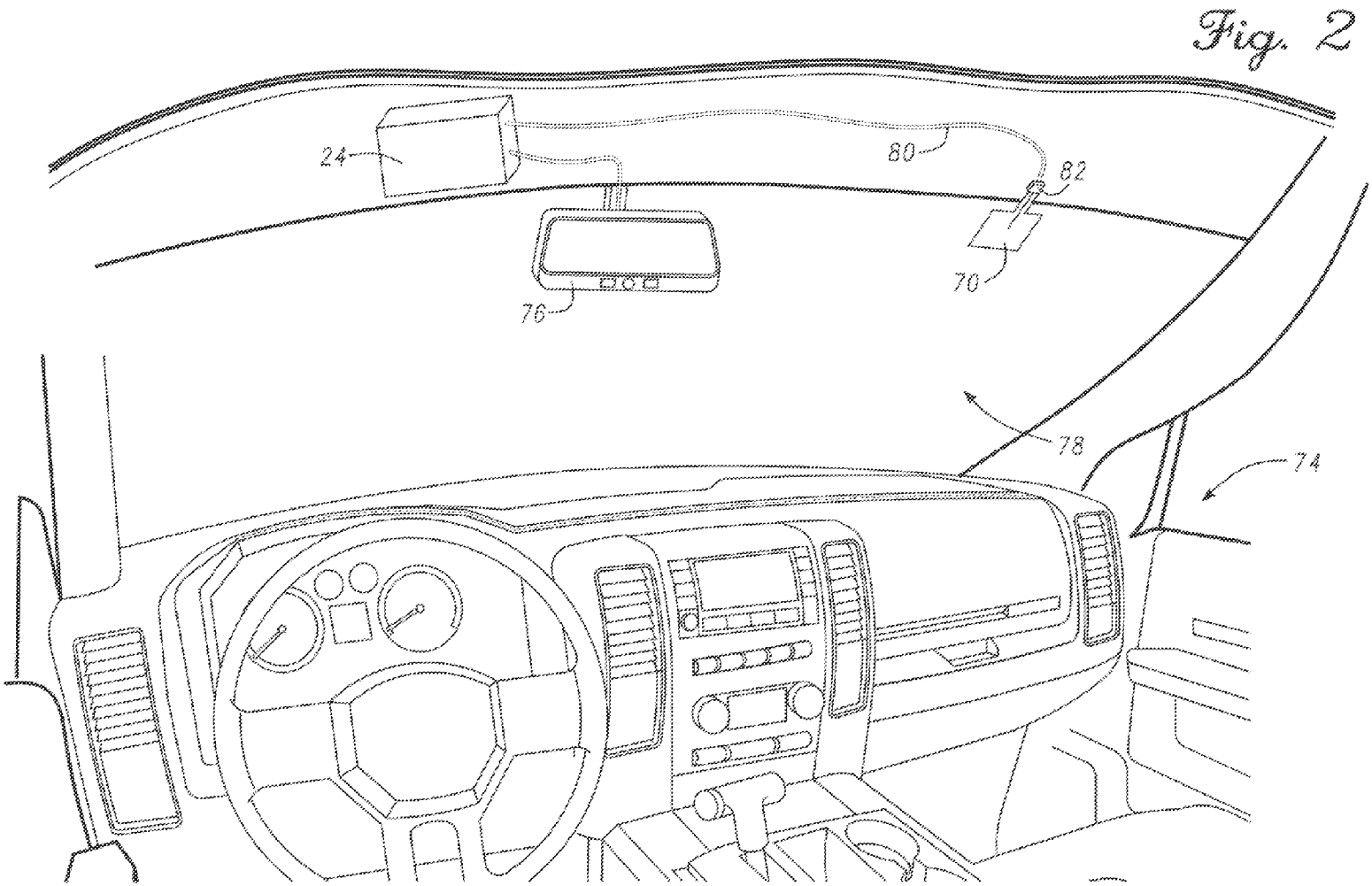
FIG. 2 is a simplified perspective fragmented cutaway view of an interior of a vehicle equipped with a non-limiting example of a connector assembly made in accordance with the teachings disclosed herein.

With respect to FIG. 2, a perspective, fragmentary, cutaway view illustrates a portion of interior 74 of vehicle 12 (FIG. 1). A rearview mirror 76 is mounted to a windshield 78. In the illustrated example, in addition to serving as a means for seeing behind vehicle 12, rearview mirror 76 also serves as a platform for mounting buttons and/or controls 30 in a position that is accessible to a driver of vehicle 12. Buttons and/or controls 30 are connected to telematics unit 24 and are configured to actuate and/or activate various features and services that are available through telematics unit 24 as depicted in FIG. 1. Some such services require communication with call center 18 or with other entities located remotely from vehicle 12 as depicted in FIG. 1.

As depicted in FIG. 1, communication with external entities may begin with a push of button and/or control 30. This action causes a signal to be transmitted to telematics unit 24. In the illustrated example, telematics unit 24 is mounted within a roof assembly of vehicle 12. In other examples, telematics unit 24 may be mounted to any suitable part of vehicle 12.

Telematics unit 24 communicates with external entities by transmitting signal through, and by receiving signals with, dual mode antenna 70. In the illustrated example depicted in FIG. 2, dual mode antenna 70 is a thin film antenna mounted directly to windshield 78. Signals are communicated between telematics unit 24 and dual mode antenna 70 along coaxial cable 80. Coaxial cable 80 is connected to dual mode antenna 70 by connector assembly 82.

Figure 3:
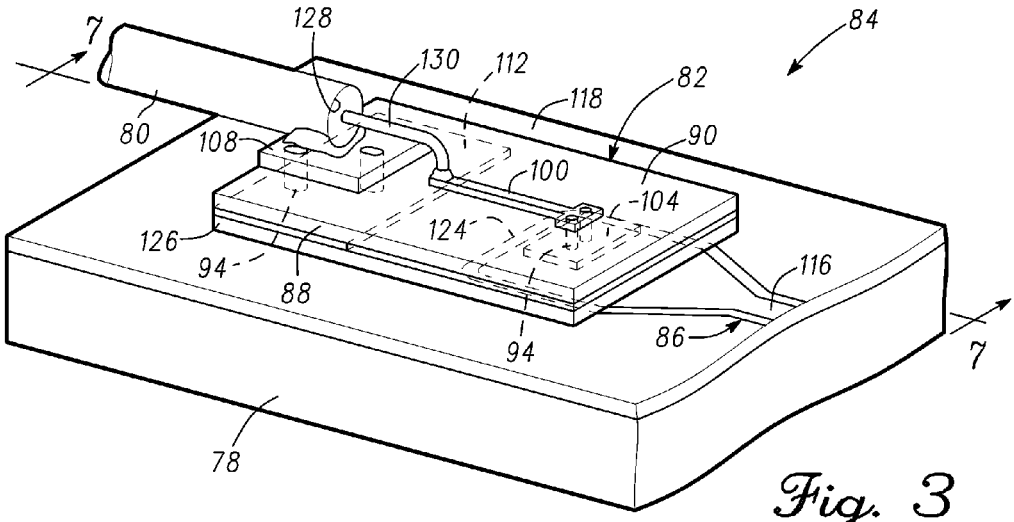
FIG. 3 is an expanded perspective view illustrating a connecting arrangement including the connector assembly of FIG. 2 and a coplanar waveguide.

With respect to FIG. 3, an example of a connecting arrangement 84 is illustrated between a non-limiting example of a connector assembly 82 and a non-limiting example of a coplanar waveguide 86. Coplanar waveguide 86 extends to the right side of FIG. 3 towards dual mode antenna 70 (not shown in FIG. 3) which is a thin film antenna and which is integral with coplanar waveguide 86. Connecting arrangement 84 is mounted to windshield 78. In other examples, connecting arrangement 84 may be mounted to any glass surface or to any other suitable surface of vehicle 12 (FIG. 1).

Figure 4:
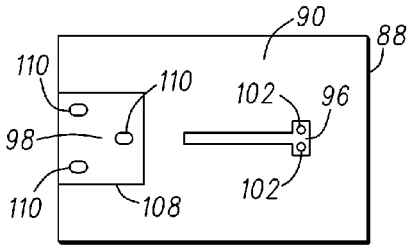
FIGS. 4 and 5 are top and bottom views, respectively, of the connector assembly illustrated in FIG. 3.
Figure 5:
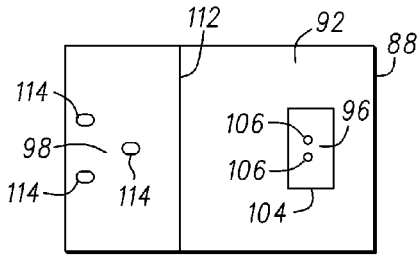

Connector assembly 82 is best seen in FIGS. 3-5. Connector assembly 82 includes a body 88 having a top side 90 (best seen in FIGS. 3 and 4) and a bottom side 92 (best seen in FIG. 5). Body 88 supports a variety of different components, discussed below. In the illustrated example, body 88 is a printed circuit board. In other examples, body 88 may be any structure suitable for supporting the components of connector assembly 82 (FIG. 3) and may be made from any suitable dielectric material.

Body 88 includes a plurality of via holes 94 (see FIGS. 7 and 8) extending through body 88 and which provide a first electrically conductive pathway 96 and a second electrically conductive pathway 98 (see FIGS. 4 and 5) between the top side 90 and the bottom side 92 of body 88. In the illustrated example, first electrically conductive pathway 96 includes two via holes 94 and second electrically conductive pathway 98 includes three via holes 94. In other examples, a greater or lesser number of via holes 94 may be employed. Additionally, in other examples, body 88 may not include any via holes 94. Instead, other means may be employed for creating electrically conductive pathways between the top side 90 and the bottom side 92. For example, conductors may be integrated into body 88 such that the conductors extend entirely through body 88 when body 88 is formed.

As depicted in FIG. 3, a microstrip 100 is attached to top side 90 of body 88. Microstrip 100 may be attached to body 88 in any suitable manner including the use of adhesives and/or epoxies. In other examples, microstrip 100 may be integrated into body 88 when body 88 is formed or may be attached to body 88 through the use of printed circuit board technologies.

Microstrip 100 is positioned over the via holes 94 that comprise the first electrically conductive pathway 96 and is electrically connected to the via holes 94 of the first electrically conductive pathway 96. In some examples, microstrip 100 is positioned on body 88 before via holes 94 are drilled such that the drilling also forms holes 102 in microstrip 100.

A bottom signal plate 104 (FIGS. 3, 5) is attached to bottom side 92 of body 88. Bottom signal plate 104 may be attached to body 88 in any suitable manner including the use of adhesives and/or epoxies and/or through the use of printed circuit board technologies. In other examples, bottom signal plate 104 may be integrated into body 88 when body 88 is formed.

Figure 7:
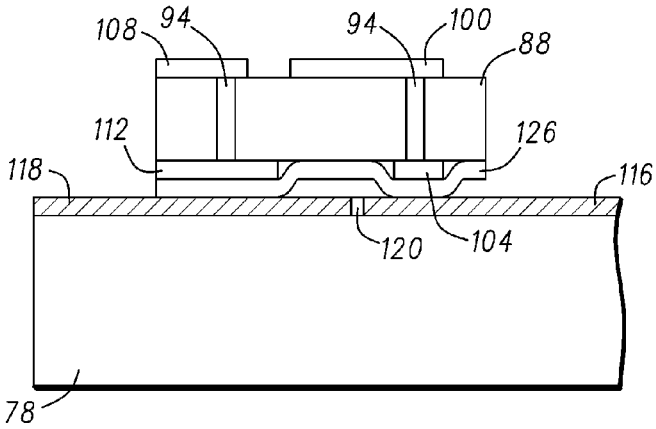
FIG. 7 is a schematic cross sectional view taken across the line 7-7 of FIG. 3.
Figure 8:
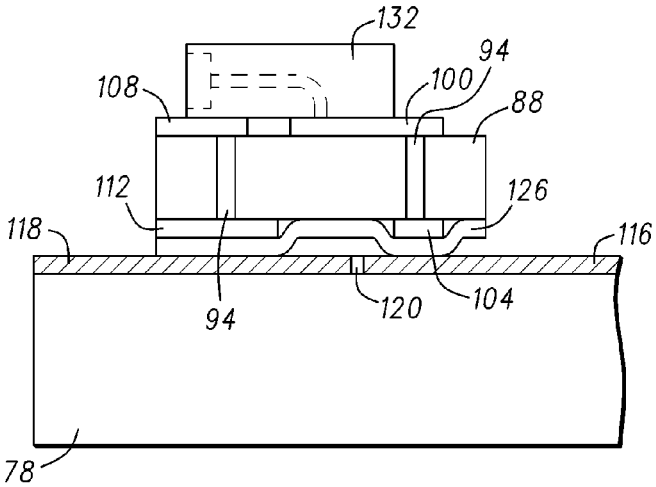
FIG. 8 is a schematic cross sectional view illustrating an alternate example of the connecting arrangement of FIG. 7.

Bottom signal plate 104 may be constructed from any suitable conductive material, for example, copper and may have any suitable configuration. Configuring bottom signal plate 104 in the form of a relatively thin plate may be beneficial in that the thinner bottom signal plate 104 is, the closer connector assembly 82 comes to being planar, as is seen in FIGS. 7 and 8. Also, it may be desirable to maximize the surface area of a bottom portion of bottom signal plate 104 (without exceeding the footprint of coplanar waveguide 86) as this may facilitate capacitive coupling between microstrip 100 and coplanar waveguide 86. In the illustrated example, bottom signal plate 104 is depicted as a rectangular plate, but it should be understood that other geometries may also be employed.

Bottom signal plate 104 is positioned on bottom side 92 so as to be aligned over via holes 94 of first electrically conductive pathway 96. In some examples, bottom signal plate 104 is positioned on body 88 before via holes 94 are drilled such that the drilling also forms holes 106 (FIG. 5) in bottom signal plate 104. Bottom signal plate 104 is electrically connected to the via holes 94 of the first electrically conductive pathway 96.

A top grounding plate 108 (FIGS. 3, 4) is attached to top side 90 of body 88 in a spaced apart relationship with microstrip 100. Top grounding plate 108 may be attached to body 88 in any suitable manner including the use of adhesives and/or epoxies or through the use of printed circuit board technologies. In other examples, top grounding plate 108 may be integrated into body 88 when body 88 is formed.

Top grounding plate 108 may be constructed from any suitable conductive material, for example, copper and may have any suitable configuration. Configuring top grounding plate 108 in the form of a relatively thin plate extends its conductive surface area and contributes to maintaining an overall thin profile of connector assembly 82. In the illustrated example depicted in FIGS. 3 & 4, top grounding plate 108 is depicted as a rectangular plate, but it should be understood that other geometries may also be employed.

Top grounding plate 108 is aligned over via holes 94 of second electrically conductive pathway 98 and is electrically connected to the via holes 94 of the second electrically conductive pathway 98. In some examples, top grounding plate 108 is positioned on body 88 before via holes 94 are drilled such that the drilling also forms holes 110 (FIG. 4) in top grounding plate 108.

A bottom grounding plate 112 (FIGS. 3, 5) is attached to bottom side 92 of body 88 in a spaced apart relationship with bottom signal plate 104. Bottom grounding plate 112 may be attached to body 88 in any suitable manner including the use of adhesives and/or epoxies or through the use of printed circuit board technologies. In other examples, bottom grounding plate 112 may be integrated into body 88 when body 88 is formed.

Bottom grounding plate 112 may be constructed from any suitable conductive material, for example, copper and may have any suitable configuration. Configuring bottom grounding plate 112 in the form of a relatively thin plate may be beneficial in that the thinner bottom grounding plate 112 is, the closer connector assembly 82 comes to being planar, as is seen in FIGS. 7 and 8. Also, it may be desirable to maximize the surface area of a bottom portion of bottom grounding plate 112 as this may facilitate capacitive coupling between the ground for microstrip 100 and grounding plane 118 of coplanar waveguide 86. In the illustrated example, bottom grounding plate 112 is depicted as a rectangular plate, but it should be understood that other geometries may also be employed.

Bottom grounding plate 112 is positioned on bottom side 92 so as to be aligned over via holes 94 of second electrically conductive pathway 98 and is electrically connected to the via holes 94 of the second electrically conductive pathway 98. In some examples, bottom grounding plate 112 is positioned on body 88 before via holes 94 are drilled such that the drilling also forms holes 114 (FIG. 5) in bottom grounding plate 112. Bottom grounding plate 112 acts as the ground for microstrip 100. The capacitive coupling between bottom grounding plate 112 and coplanar waveguide 86 effectively makes the ground for microstrip 100 and the ground for coplanar waveguide 86 the same, as understood by those of ordinary skill in the art.

Figure 6:
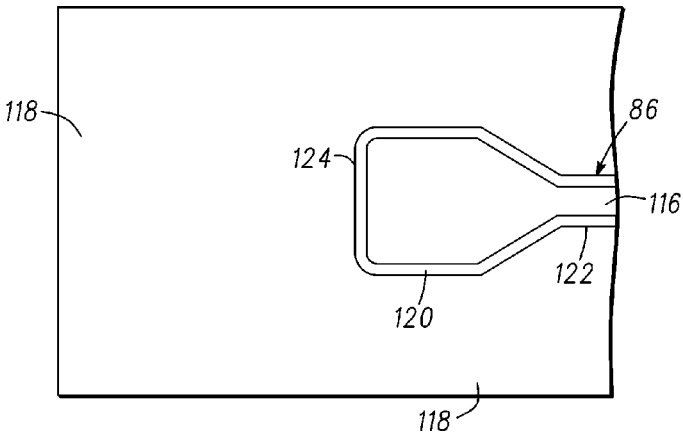
FIG. 6 is a top view of the coplanar waveguide illustrated in FIG. 3.

Coplanar waveguide 86, as best seen in FIGS. 3 and 6, includes a center conductor 116 and a grounding plane 118. Center conductor 116 and grounding plane 118 each comprise metallization disposed on a surface of a thin film material. In other examples, coplanar waveguide 86 may be made from a relatively thin layer of any conducting material including, but not limited to, metal materials. In other examples, coplanar waveguide 86 may be disposed on any surface and is not limited to employment with thin films. For example, a coplanar waveguide may be etched on a printed circuit board. In other examples, coplanar waveguide 86 may be disposed directly onto a glass surface such as, but not limited to, a window or a windshield. Center conductor 116 and grounding plane 118 are separated by a gap 120 (FIG. 6) which is substantially devoid of metallization and therefore serves to insulate grounding plane 118 from center conductor 116.

As depicted in FIG. 6, gap 120 circumscribes a periphery of center conductor 116 and forms a loop 122. In the illustrated example, an end of loop 122 widens outwardly to form a widened end 124. Providing a widened end to loop 122 facilitates assembly of the connection assembly and permits a greater tolerance for positioning errors than would be provided by a loop that did not include widened end 124. In one example, coplanar waveguide 86 has a characteristic impedance of 50 Ohms. In that example, widened end 124 also has a characteristic impedance of 50 Ohms and allows a position tolerance for the connector assembly of at least ±0.08 inches in any direction.

When connector assembly 82 is placed over coplanar waveguide 86 for attachment, connector assembly 82 is positioned such that bottom signal plate 104 aligns with widened end 124 of center conductor 116 and such that bottom grounding plate 112 aligns with grounding plane 118.

A dielectric adhesive 126 (FIG. 3) is disposed on the bottom side of body 88 and on bottom surfaces of bottom grounding plate 112 and bottom signal plate 104. Dielectric adhesive 126 forms a robust connection between coplanar waveguide 86 and connector assembly 82 and serves as a barrier to prevent direct contact between these two components. Dielectric adhesive 126 may be a relatively thin layer that maintains bottom signal plate 104 and bottom grounding plate 112 in close proximity to center conductor 116 and grounding plane 118, respectively. In one example, dielectric adhesive 126 had a thickness of approximately 0.002 inches. A thickness of this magnitude permits the center conductor 116 and grounding plane 118 of coplanar waveguide 86 to be capacitively coupled with the bottom signal plate 104 and bottom grounding plate 112 of connector assembly 82, respectively. Dielectric adhesive 126 may include a backing which is removed just before connector assembly 82 is attached to coplanar waveguide 86.

As depicted in FIG. 3, coaxial cable 80 includes a grounding shield 128 and a central conductor 130. In one example, coaxial cable 80 may be attached to connector assembly 82 by soldering grounding shield 128 to top grounding plate 108 and by soldering central conductor 130 to microstrip 100. As illustrated in FIG. 3, microstrip 100 extends in a direction towards top grounding plate 108. In other examples, connector assembly 82 may not include microstrip 100. Instead, central conductor 130 may be soldered directly to one or more of the via holes 94 of first electrically conductive pathway 96. The use of solder provides both a robust mechanical connection and an electrical connection between coaxial cable 80 and connector assembly 82. In other examples, discussed below, alternate means of connecting coaxial cable 80 to connector assembly 82 may be employed. As illustrated in FIG. 3, microstrip 100 extends in a direction towards top grounding plate 108. In other examples, connector assembly 82 may not include microstrip 100. Instead, central conductor 130 may be soldered directly to one or more of the via holes 94 of first electrically conductive pathway 96. The use of solder provides both a robust mechanical connection and an electrical connection between coaxial cable 80 and connector assembly 82. In other examples, discussed below, alternate means of connecting coaxial cable 80 to connector assembly 82 may be employed.

When a signal is received by dual mode antenna 70 (FIGS. 1, 2), it propagates along coplanar waveguide 86 towards connector assembly 82. By virtue of the capacitive coupling arrangement between bottom signal plate 104 and center conductor 116, the signal is transmitted from center conductor 116 to bottom signal plate 104. In examples where the characteristic impedance of coplanar waveguide 86 is substantially the same as the characteristic impedance of microstrip 100, the signal can be transmitted between coplanar waveguide 86 and microstrip 100 with relatively low loss of signal strength. In some examples, additional components and/or circuitry may be mounted on the top side 90 of body 88 to boost or otherwise manipulate the signal as it is transmitted along microstrip 100. For example, a diplexer may be employed to connect two coaxial cables to connector assembly 82. These two cables may then be connected to two independent radios or other component that operate in different frequency bands. In another example, a low-noise amplifier or other active circuitry may be positioned on the top side 90 of body 88 in between via holes 94 and coaxial cable 80. The circuitry should be placed in line with microstrip 100, as is common in the art of microwave circuit design.

FIG. 7 is a schematic cross sectional view taken across the line 7-7 of FIG. 3 and illustrates the arrangement of the various components of the connecting arrangement of FIG. 3. In this view, via holes 94 can be seen extending entirely through body 88 and dielectric adhesive 126 can be seen interposed between grounding plane 118 and bottom grounding plate 112 and between center conductor 116 and bottom signal plate 104.

FIG. 8 is a schematic cross sectional view similar to that of FIG. 7, but illustrates an alternate example of connector assembly 82 (FIG. 3). In the example illustrated in FIG. 8, connector assembly 82 includes a connector or terminal 132. Terminal 132 facilitates the connection of coaxial cable 80 (FIG. 3) to connector assembly 82 and also permits coaxial cable 80 to be disconnected from connector assembly 82. Terminal 132 is configured to receive coaxial cable 80 and to electrically connect grounding shield 128 (FIG. 3) to top grounding plate 108 and to electrically connect central conductor 130 to microstrip 100. In some examples, coaxial cable 80 may attach to terminal 132 through a threaded engagement. In other examples, a snap fit engagement may be employed. In still other examples, any means effective for attaching coaxial cable 80 to terminal 132 may be employed.

Figure 9:
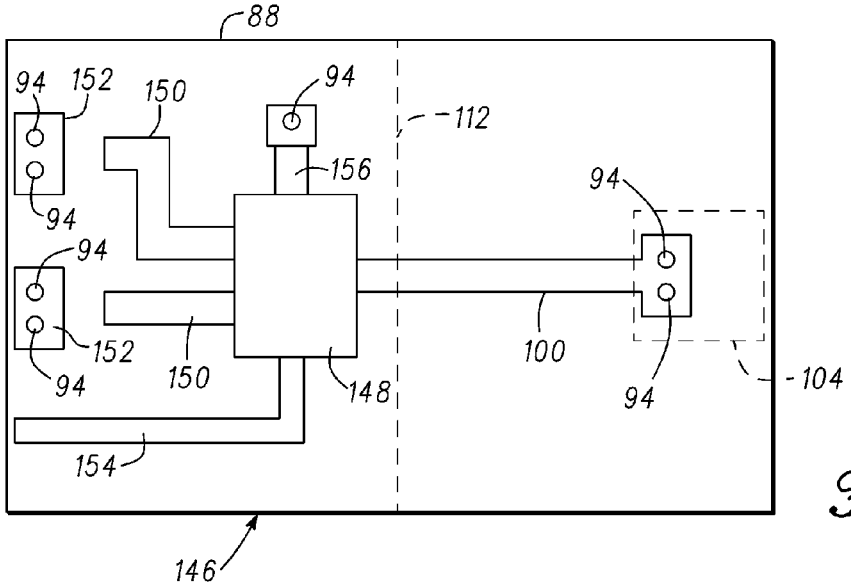
FIG. 9 is a schematic plan view of an alternate example of a connector assembly made in accordance with the teachings disclosed herein.

With respect to FIG. 9, an alternate example of a connector assembly 146 is illustrated. Connector assembly 146 includes microstrip 100 on a top of connector assembly 146 and bottom signal plate 104 on a bottom of connector assembly 146. As before, via holes 94 electrically connect microstrip 100 to bottom signal plate 104. Connector assembly 146 further includes circuit 148 connected in line with microstrip 100. Circuit 148 may comprise any type of circuit. In one non-limiting example, circuit 148 may comprise a passive surface mount component(s). In another non-limiting example, circuit 148 may comprise an integrated circuit(s). In yet another non-limiting example, circuit 148 may comprise a distributed microstrip network. In still other non-limiting examples, circuit 148 may comprise a combination of any or all of the foregoing examples.

Two microstrip lines 150 extend from circuit 148 to two top grounding plates 152. Each of the two top grounding plates 152 are electrically connected to bottom grounding plate 112 (not shown in FIG. 9) by via holes 94. The two Microstrip lines 150 and the two top grounding plates 152 each are configured to permit the mounting of two coaxial cables (not shown in FIG. 9). In other examples, any desirable number of microstrip lines 150 and top grounding plates 152 may be employed to permit the mounting of a corresponding number of coaxial cables.

In the illustrated example, a third microstrip line 154 extends from circuit 148 to and edge of body 88. Microstrip line 154 permits a power line and/or a control line to be connected to connector assembly 146. Additionally as depicted in FIG. 9, a grounding line 156 connects circuit 148 to bottom grounding plate 112 through another via hole 94.

Figure 10:
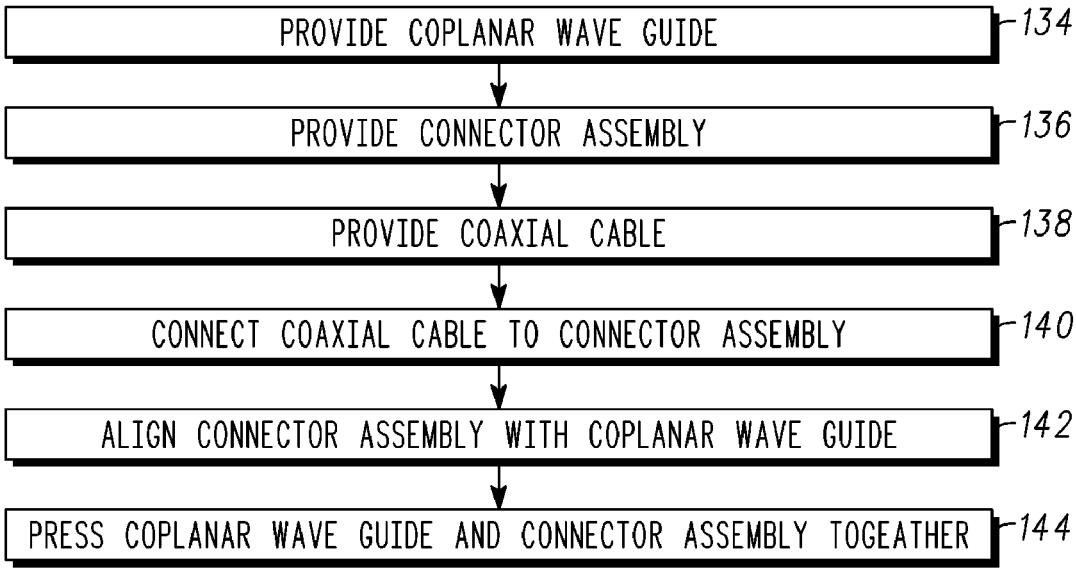
FIG. 10 is a flow chart illustrating a method of assembling the connecting arrangement of FIG. 7.

With respect to FIG. 10, an exemplary method for assembling the connecting arrangement of FIG. 3 is described. At step 134, coplanar waveguide 86 is provided and at step 136, connector assembly 82 is provided.

At step 138, a coaxial cable is provided. In other examples, rather than using a coaxial cable, other types of waveguides and/or transmission lines may be employed. At step 140, the coaxial cable is connected to connector assembly 82. In some examples, this may be accomplished by soldering the coaxial cable to connector assembly 82. In other examples, connector assembly 82 may include terminal 132 (FIG. 8) to facilitate the connection and subsequent removal of coaxial cable to and from connector assembly 82. In such examples, the coaxial cable would be connected to connector assembly in any manner called for by terminal 132.

At step 142, connector assembly 82 is aligned with coplanar waveguide 86 such that bottom signal plate 104 is aligned with center conductor 116 and such that bottom grounding plate 112 is aligned with grounding plane 118. In examples of coplanar waveguide 86 where gap 120 forms a loop having widened end 124 as depicted in FIG. 6, this alignment step is simplified because widened end 124 provides a larger target area with which to align bottom signal plate 104. The use of widened end 124 permits a higher tolerance for location errors during the assembly of connecting arrangement 84.

At step 144, connector assembly 82 is attached to coplanar waveguide 86 by pressing the two components together. This allows dielectric adhesive 126 to contact coplanar waveguide and to adhere thereto. In examples where dielectric adhesive 126 includes a backing layer, that layer would first need to be removed. This may be done either at step 142 or at step 144, or at any other suitable time. In examples where terminal 132 is utilized, it may be desirable to perform steps 142 and 144 prior to attaching the coaxial cable.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

What is claimed is:

1. A connector assembly comprising:

a body having a top side and a bottom side;

a bottom signal plate connected to the bottom side, the bottom signal plate being configured for capacitive coupling to a conductor of a coplanar waveguide;

a bottom grounding plate connected to the bottom side and spaced apart from the bottom signal plate, the bottom grounding plate being configured for capacitive coupling to a grounding plane of the coplanar waveguide;

a first electrically conductive pathway electrically connected to the bottom signal plate and extending to the top side;

a second electrically conductive pathway electrically connected to the bottom grounding plate and extending to the top side;

a dielectric adhesive at least partially covering the bottom signal plate and the bottom grounding plate;

a top grounding plate disposed on the top side, the top grounding plate being electrically connected to the bottom grounding plate through the second electrically conductive pathway; and a microstrip disposed on the top side and electrically connected to the bottom signal plate through the first electrically conductive pathway, the microstrip and the top grounding plate being spaced apart, wherein the microstrip extends from the first electrically conductive pathway towards the top grounding plate.

2. The connector assembly of claim 1, wherein the body, the bottom signal plate, the bottom grounding plate, the first electrically conductive pathway and the second electrically conductive pathway comprise a printed circuit board.

3. The connector assembly of claim 1, further comprising a terminal attached to the microstrip and the top grounding plate on the top side, the terminal being configured to receive a coaxial cable and the terminal being electrically connected to the first electrically conductive pathway and to the second electrically conductive pathway.

4. The connector assembly of claim 1 further comprising circuitry in line with the microstrip.

5. A method of assembling a connector arrangement, the method comprising the steps of:

providing a coplanar waveguide having a center conductor and a grounding plane;

providing a connector assembly including:

a body having a top side and a bottom side;

a bottom signal plate connected to the bottom side;

a bottom grounding plate connected to the bottom side and spaced apart from the bottom signal plate;

a first electrically conductive pathway electrically connected to the bottom signal plate and extending to the top side;

a second electrically conductive pathway electrically connected to the bottom grounding plate and extending to the top side; and a dielectric adhesive at least partially covering the bottom signal plate and the bottom grounding plate;

aligning the connector assembly with the coplanar waveguide such that the bottom signal plate aligns with the center conductor and such that the bottom grounding plate aligns with the grounding plane; and pressing the connector assembly and the coplanar waveguide together such that the dielectric adhesive adheres the connector assembly to the coplanar a waveguide wherein a gap is disposed about a periphery of the center conductor such that the center conductor and the grounding plane are spaced apart, the gap being configured as a loop with a widened end, the method further comprising the step of aligning the bottom signal plate with the widened end.

6. The method of claim 5, wherein the connector assembly further includes a top grounding plate disposed on the top side, the top grounding plate being electrically connected to the bottom grounding plate through the second electrically conductive pathway, wherein the connector assembly further includes a microstrip disposed on the top side, the microstrip being electrically connected to the bottom signal plate through the first electrically conductive pathway, wherein the microstrip and the top grounding plate are spaced apart, the method further comprising the steps of:

providing a coaxial cable having a central conductor and a grounding shield; and connecting the coaxial cable to the connector assembly such that the grounding shield is electrically connected to the top grounding plate and the central conductor is electrically connected to the microstrip.

7. The method of claim 6 wherein the connecting step comprises soldering the grounding shield to the top grounding plate and soldering the central conductor to the micro strip.

8. A connecting arrangement comprising:

a coplanar waveguide having a center conductor and a grounding plane; and a connector assembly including:

a body having a top side and a bottom side;

a bottom signal plate connected to the bottom side;

a bottom grounding plate connected to the bottom side and spaced apart from the bottom signal plate;

a first electrically conductive pathway electrically connected to the bottom signal plate and extending to the top side;

a second electrically conductive pathway electrically connected to the bottom grounding plate and extending to the top side; and a dielectric adhesive at least partially covering the bottom signal plate and the bottom grounding plate wherein the bottom signal plate is capacitively coupled with the center conductor, wherein the bottom grounding plate is capacitively coupled with the grounding plane, and wherein the dielectric adhesive adheres the connector assembly to the coplanar waveguide and wherein a gap is disposed about a periphery of the center conductor such that the center conductor and the grounding plane are spaced apart, the gap being configured as a loop with a widened end and wherein the bottom signal plate is aligned with the widened end.

9. The connecting arrangement of claim 8:

wherein the body comprises a printed circuit board;

wherein a gap is disposed about a periphery of the center conductor such that the center conductor and the grounding plane are spaced apart, the gap being configured as a loop with a widened end, wherein the bottom signal plate is aligned with the widened end, wherein the connector assembly further includes a top grounding plate disposed on the top side, the top grounding plate being electrically connected to the bottom grounding plate through the second electrically conductive pathway, wherein the connector assembly further includes a microstrip disposed on the top side, the microstrip being electrically connected to the bottom signal plate through the first electrically conductive pathway, the microstrip and the top grounding plate being spaced apart, wherein the microstrip extends from the first electrically conductive pathway towards the top grounding plate, wherein a characteristic impedance of the microstrip is substantially the same as a characteristic impedance of the coplanar waveguide, wherein the first electrically conductive pathway comprises a via hole, and wherein the second electrically conductive pathway comprises a via hole.

10. The connecting arrangement of claim 8, wherein the body, the bottom signal plate, the bottom grounding plate, the first electrically conductive pathway and the second electrically conductive pathway comprise a printed circuit board.

11. The connecting arrangement of claim 8, wherein the connector assembly further includes a microstrip disposed on the top side, the microstrip being electrically connected to the bottom signal plate through the first electrically conductive pathway.

12. The connecting arrangement of claim 11, wherein a characteristic impedance of the microstrip is substantially the same as a characteristic impedance of the coplanar waveguide.

13. The connecting arrangement of claim 8, wherein the connector assembly further includes a top grounding plate disposed on the top side, the top grounding plate being electrically connected to the bottom grounding plate through the second electrically conductive pathway.

14. The connecting arrangement of claim 13, wherein the connector assembly further includes a microstrip disposed on the top side and electrically connected to the bottom signal plate through the first electrically conductive pathway, the microstrip and the top grounding plate being spaced apart.

* * * * *